US005940945A

United States Patent [19]

Bommer et al.

[11] Patent Number: 5,940,945

[45] Date of Patent: Aug. 24, 1999

[54] SHED INSERTIBLE SENSOR FOR DIVIDING-SHED FORMATION ON A SECTIONAL WARPING MACHINE

[75] Inventors: Guido Bommer, Wil; Markus Beerli, Gossau, both of Switzerland

[73] Assignee: Benninger AG, Uzwil, Switzerland

[21] Appl. No.: 09/021,382

[22] Filed: Feb. 10, 1998

[30] Foreign Application Priority Data

Mar. 14, 1997 [CH] Switzerland ..... 0619/97

[51] Int. Cl.[6] ..... D02H 9/00

[52] U.S. Cl. ..... 28/198; 28/187; 28/191; 28/185; 139/353; 139/370.2

[58] Field of Search ..... 139/452, 368, 139/353, 370.2, 354, 355, 116.2; 28/187, 191, 192, 198, 172.1, 185

[56] References Cited

U.S. PATENT DOCUMENTS

| | | | |
|---|---|---|---|
| 3,751,937 | 8/1973 | Bassist | 28/187 |
| 3,765,777 | 10/1973 | Williams | 28/187 |
| 3,869,770 | 3/1975 | McCullough | 28/187 |
| 4,270,579 | 6/1981 | Nakanishi | 139/370.2 |
| 4,805,671 | 2/1989 | Castellini et al. | 139/370.2 |
| 4,974,301 | 12/1990 | Beerli et al. | 28/185 |
| 5,154,209 | 10/1992 | Takegawa | 139/452 |

FOREIGN PATENT DOCUMENTS 0 368 801 5/1990 European Pat. Off. .

*Primary Examiner*—Andy Falik
*Attorney, Agent, or Firm*—Shoemaker and Mattare, Ltd.

[57] ABSTRACT

On a sectional warping machine, the dividing-shed formation for introducing a dividing element is controlled in such a way that at least one yarn sensor (18, 18') is introduced transversely to the running direction of the shed warp (11, 12) into the opened dividing shed (15). The yarn sensor generates a control signal on detecting an incorrectly arranged yarn (34) in the feed area. The yarn sensor is preferably introduced into the dividing shed (15) together with a motor-driven element transporter (13), wherein the drive of the element transporter can be switched off and/or reversed by the control signal.

13 Claims, 4 Drawing Sheets

SHED INSERTIBLE SENSOR FOR DIVIDING-SHED FORMATION ON A SECTIONAL WARPING MACHINE

BACKGROUND OF THE INVENTION

The invention concerns a method and a device for the control of dividing-shed formation on a sectional warping machine according to the preamble to claim 1, respectively claim 3. It is already known that the purpose of yarn division on a sectional warping machine is to form yarn crossings that later facilitate further processing of the warp yarns. For sizing of the warp yarns, too, dividing elements require introduction into the warp yarns, so that unravelling of said warp yarns after leaving the size bath is assured.

Devices for semi-automatic or automatic formation of the shed have, in preparation for weaving, already been state of the art and in use for a long time. A principle requirement for correct yarn division is that the divided shed warps are correctly separated, and that one or more yarns are not allocated by the dividing element to the wrong shed warp. This is especially possible if separate yarns adhere to one another when opening the shed and in this way are dragged to the wrong side of the shed against the normal operating yarn tension.

When manually inserting the dividing elements into the shed, such incorrect yarn alignments are as a rule quickly recognised, and can be quickly corrected. In the case of automated yarn division equipment, however, such faults are problematic, as disclosed by EP-A-368 801, for example. Therein, the dividing elements are introduced automatically into the shed from the side by means of an element transporter as soon as said shed is fully open.

With that, incorrectly tensioned yarns in the feed area can rupture, or become allocated to the wrong shed warp after positioning of the dividing element, and this can lead to subsequent faults in the warp.

SUMMARY OF THE INVENTION

It is thus a purpose of the invention to create a method of the type described in the introduction, with the aid of which the correct dividing-shed formation can be controlled in order to prevent incorrect yarn division particularly in automatic shedding devices. On detecting a fault, the working process should be interrupted automatically so that the fault can be eliminated by the operator, and in order to avoid rupture of the separate yarns. According to the present invention, this purpose is fulfilled by a method possessing the features of claim 1. From the point of view of the device, the purpose is fulfilled by a device possessing the features of claim 3.

Sensors in the form of yarn monitors are state of the art and mainly used on the creel of a sectional warping machine. However, stationary sensors are always concerned here. However, the introduction of a mobile sensor into the tensioned shed permits in a particularly simple way the detection of incorrectly tensioned yarns and triggering of the corresponding sequences with the aid of the control signal thereby generated. With that, it is no longer necessary for an operator to monitor the automatic introduction of the dividing elements, which anyway requires a high level of concentration due to the high cycle speed and the sometimes large number of yarns.

The yarn sensor is preferably introduced into the shed together with a motor-driven element transporter, the drive of said element transporter being able to be switched off and/or being reversible by means of the control signal. In this way, no separate transmission and no separate drive device is required for the sensor. By switching off and/or reversing the element transporter drive, rupturing of incorrectly tensioned yarns by a further feed motion is prevented.

The yarn sensor is preferably a contact sensor reacting to contact with the yarns, wherein a predetermined yarn tension and thus a predetermined response resistance or sensitivity can be set. The advantage of the contact sensor is that its susceptibility to detrimental outside influences is low and that fine yarns, too, can be detected without problems. Naturally, a remote sensor would also be conceivable, operating with optical, electromagnetic or other physical effects.

A particularly reliable working method for the yarn sensor can be attained if said sensor possesses a catching fork, the fork limbs of which define a specific catching area in the shed. The catching fork effects clear location of an incorrect yarn at the sensor, and at the same time a catching area can be defined with the fork limbs that is considerably larger that the actual active area of the sensor. With that, the catching fork can be formed to resemble a shovel, and can possess fork limbs formed as a wing extending out from a basis surface, the width of said basis surface being less than the width of the fork opening. On withdrawal of the element transporter, the V-shaped or U-shaped arrangement of the fork limbs also causes reliable repelling of the shed warps after introduction of the dividing element.

The catching fork is preferably mounted in bearings under spring tension on a holder so as to be movable, wherein a switching element is arranged in the holder, said switching element being able to be activated by the catching fork on touching a yarn in the catching area through a relative movement in relation to the holder. The sensitivity of the sensor can be set via spring tension, wherein the switching element only responds if a specific relative movement has been travelled.

The switching element is preferably a proximity switch, since this is less susceptible to contamination in the dusty environment of a sectional warping machine. The switching element could, however, also be a microswitch, an optical or piezoelectric switching element, or similar.

The catching fork is preferably mounted to be able to pivot about an approximately vertical axis, and tensioned by means of a spring acting against the holder, for example a pressure spring. Depending on the design of the catching fork, a lever action can be generated about the vertical axis, and in contrast to a linear guidance of the catching fork, there is no risk of crabbing or jamming.

In order to prevent the catching fork from overcoming the spring resistance due solely to mass inertia during the feed acceleration of the holder, it is preferably provided with a compensating mass. Said compensating mass must be arranged in such a way that a feed acceleration of the holder does not generate a torque at the catching fork that overcomes the spring tension, in other words that inertial balance prevails in relation to a plane running through the vertical pivot axis in the direction of feed. Only additional force effects on contacting an incorrect yarn cause a torque at the catching fork, and thus actuation of the switching element.

Operational security can in addition be increased by arranging two sensors at a distance from each other in an approximately horizontal plane. Since the individual yarns of a shed warp do not run parallel to one another, but diverge towards the creel, incorrect yarns must also be detected that are arranged in all possible inclined positions. With an arrangement of two sensors, at least one of the two sensors will always actuate in accordance with the inclined position of the incorrect yarn. The sensors, with catching forks, are with that preferably mounted on the holder in such a way that they can be pivoted in opposite directions against the tension of their respective spring.

BRIEF DESCRIPTION OF THE DRAWINGS

An embodiment of the invention is more closely described in the following and represented in the drawings: namely, FIG. 1 a side view of a sectional warping machine in a highly schematic representation.

DESCRIPTION OF THE PREFERRED EMBODIMENT

Figure 1:
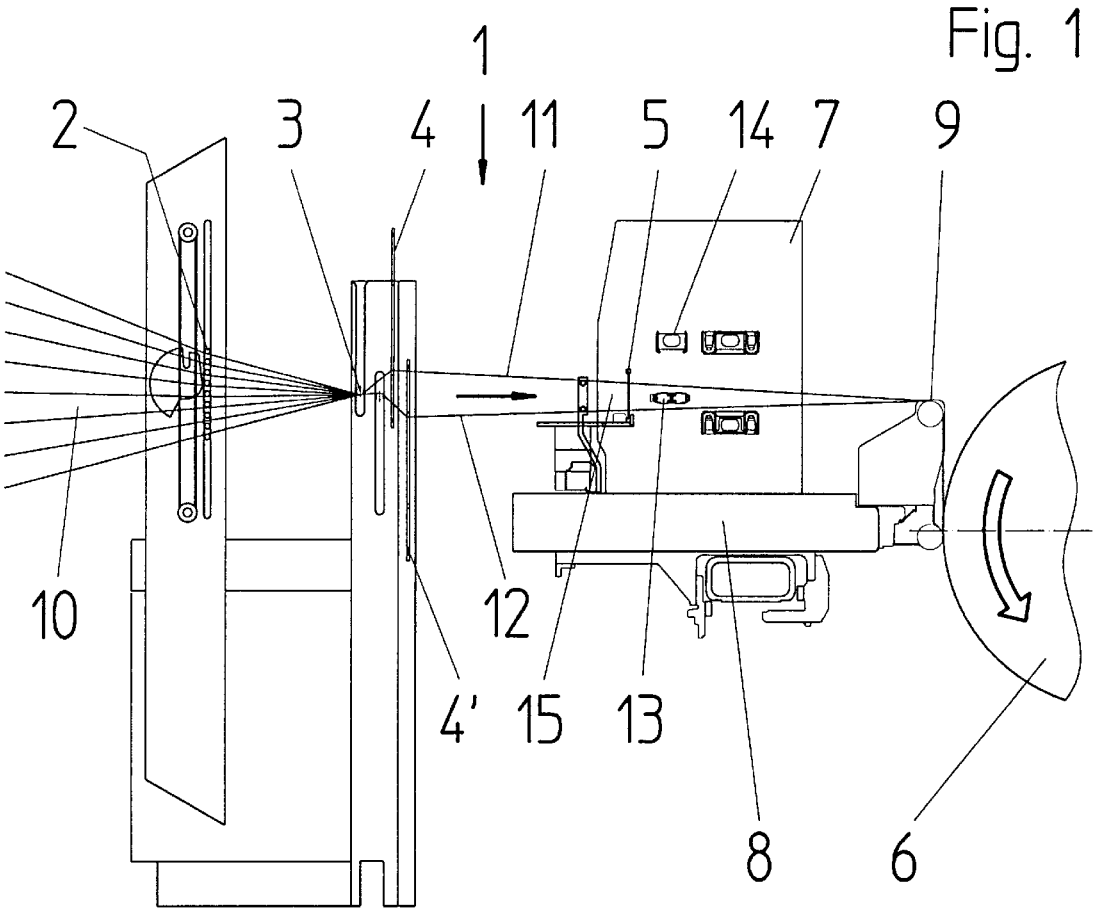

FIG. 1 shows an in principle state-of-the-art sectional warping machine 1, as described for example in the above-mentioned EP-A-368 801. The operating status of the machine is shown during introduction of a yarn crossing element. With that, a yarn strip 10, withdrawn from a creel which is not shown here, is guided through a rod grid 2. By means of guide rods 3, the yarn strip is assembled in one plane downstream of the rod grid 2. The two lease reeds 4, 4' are pushed towards one another, and thus open the dividing shed 15, which is defined by an upper shed warp 11 and a lower shed warp 12. These shed warps run through the warping reed 5, which has been pushed back with the aid of a laterally arranged dividing device 7, in order to introduce a dividing element.

The warping reed 5 is arranged according to the state of the art on a warping carriage 8, said warping carriage being able to be displaced in the parallel and radial directions in relation to a sectional warping drum 6, and supporting a deflection roller 9. The warping carriage also supports the dividing device 7, which is thus always arranged in the same relative lateral position to the shed warps. In each case, an upper and a lower element transporter 13, 14 can be extended on the dividing device. The lower element transporter 13 always ingresses into the opened shed 15; the upper element transporter can be lowered onto the lower element transporter.

Figure 2:
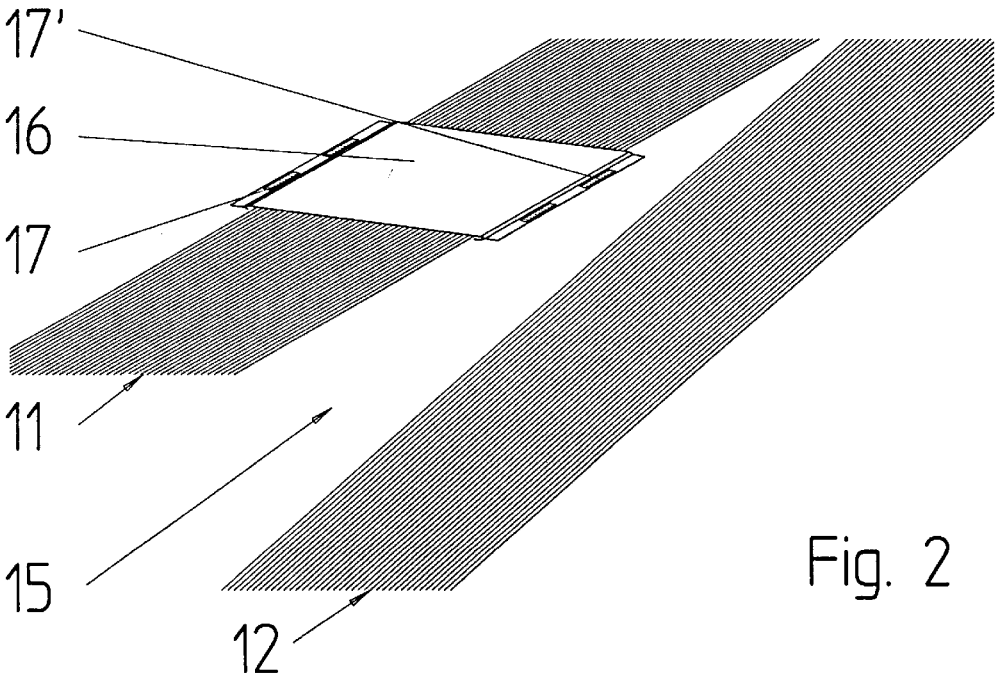
FIG. 2 a perspective representation of a dividing element on a shed warp.

With the aid of element transporters 13, 14, two strips of film are guided laterally beneath, respectively above the upper shed warp 11, as can be seen in FIG. 2. Both film strips are each connected together by means of a lateral weld bead 17, 17' and combine to form the dividing element 16. Naturally, other dividing elements could also be introduced. In the case of division for sizing, the procedure is basically the same, wherein other types of shed warps are formed with the aid of the rod grid 2 only. This method is basically known to the expert in the art, however, and will not be more fully explained here.

Figure 3:
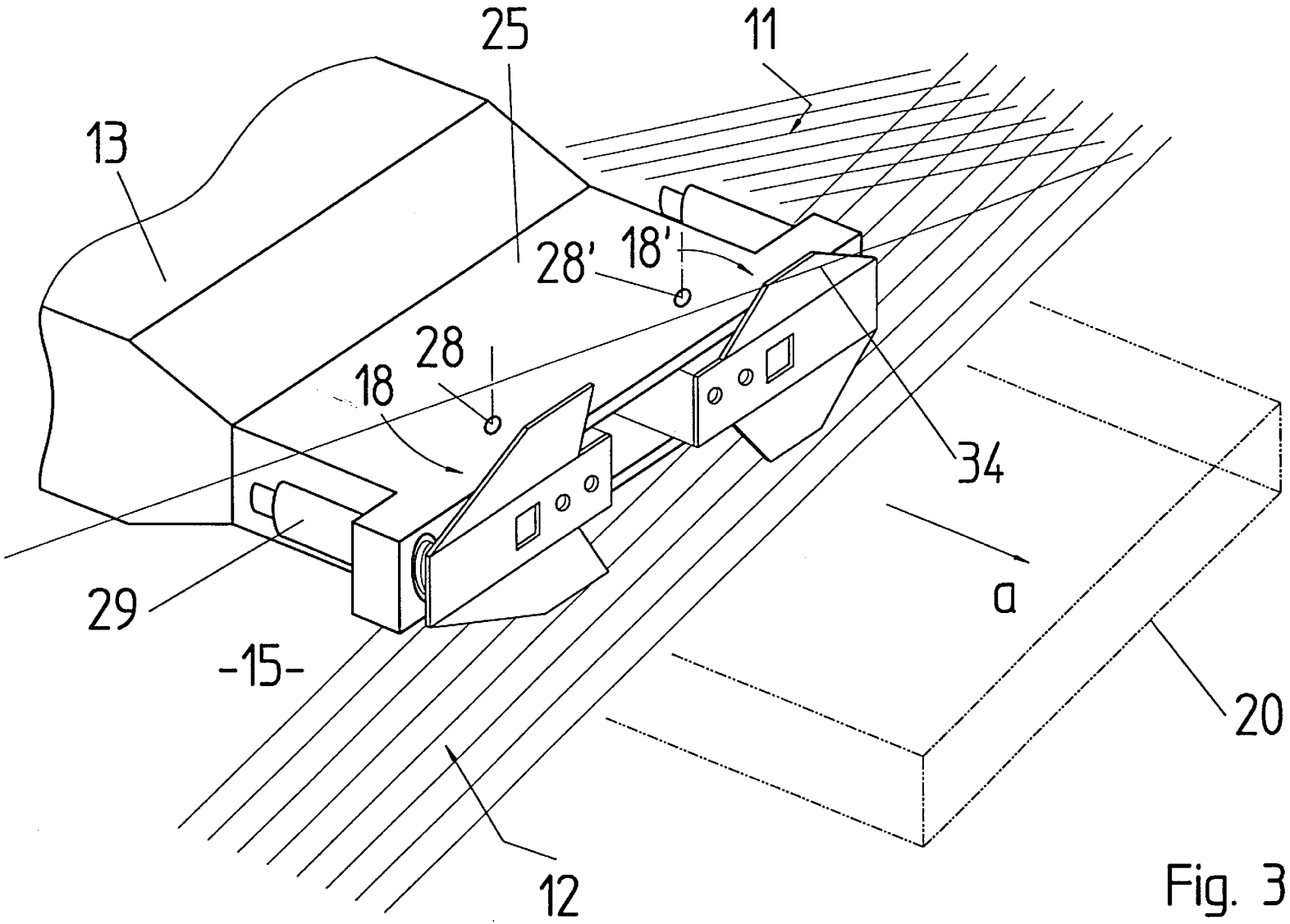
FIG. 3 a device according to the present invention on introduction into an opened shed.

FIG. 3 schematically shows the lower element transporter 13 as described above, said element transporter being introduced into the opened shed 15 in the direction of the arrow a. The upper shed warp 11 and the lower shed warp 12 are, again, shown schematically. An incorrect yarn 34 is also shown which, for example, would be allocated to the upper shed warp 11, but which runs through the opened shed 15 due to an operating fault.

The device according to the present invention is arranged at the head of the element transporter 13. Said device comprises a holder 25 on the face of which two yarn sensors 18, 18' are arranged at a distance from each other. The yarn sensors, respectively the catching forks 19 (FIG. 4) allocated to said yarn sensors, define a catching area 20 which has been depicted by means of a dotted line. The incorrect yarns 34 crossing this catching area are thus detected by the sensor 18', which generates a control signal in a way described in the following. This control signal causes immediate switch-off of the feed, and triggers an alarm which attracts the attention of the operator. After elimination of the fault, automatic operation can be continued in the normal way.

Figure 4:
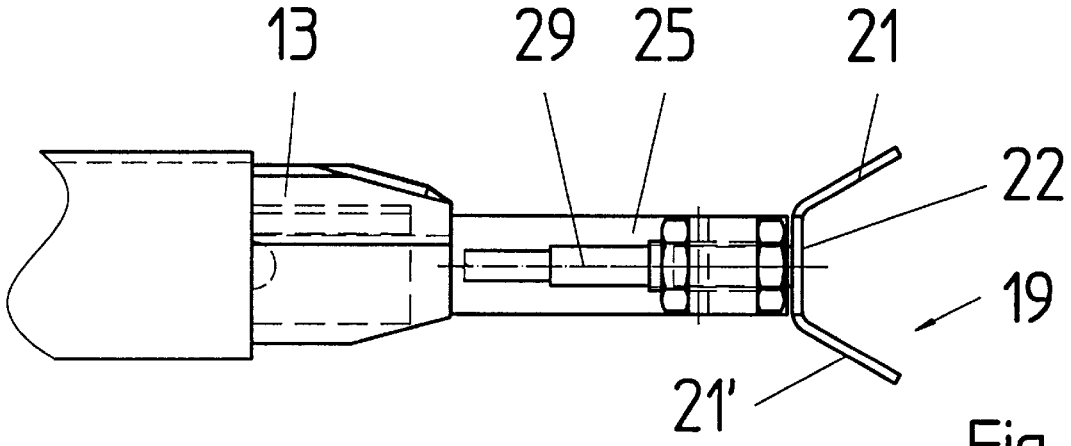
FIG. 4 a side view onto the device according to FIG. 3, seen in the direction of yarn run.
Figure 5:
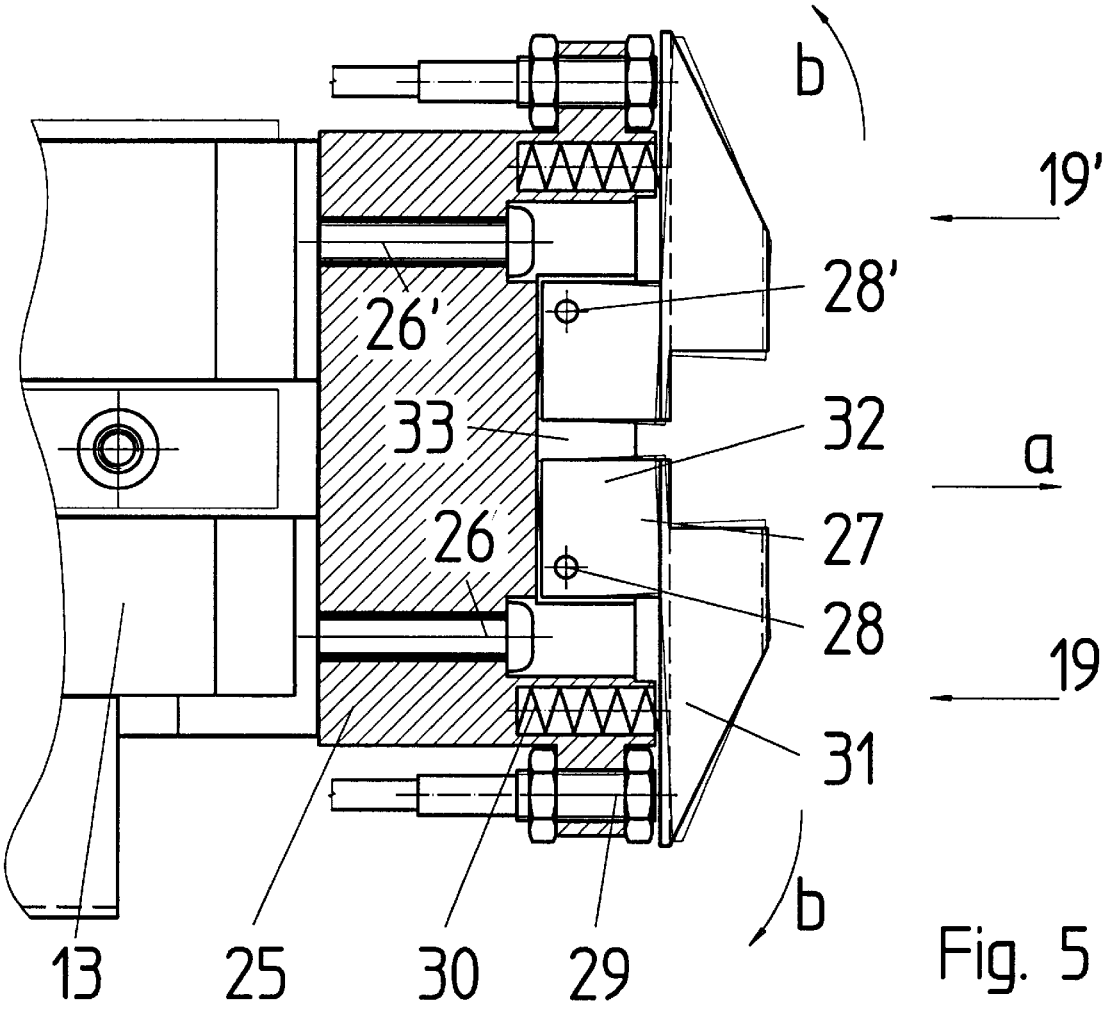
FIG. 5 a plan view onto the device according to FIG. 3.
Figure 6:
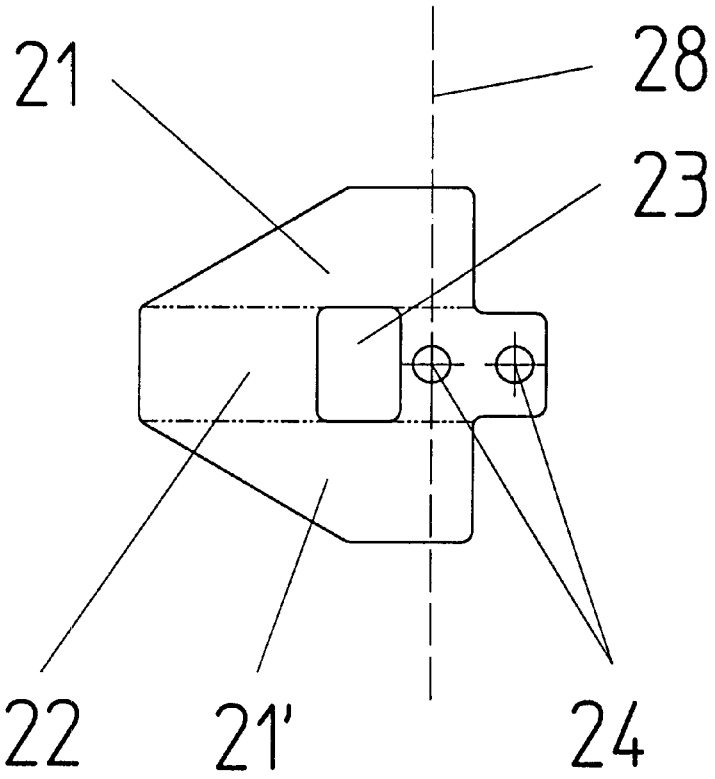
FIG. 6 a plan view onto an individual catching fork.

Details of the device according to the present invention can further be seen in FIGS. 4 to 6. The holder 25 is formed as an approximately rectangular body screwed to the element transporter 13 by means of two fixing screws 26, 26'. The two sensors, formed as catching forks 19, 19', are each mounted on the holder 25 to be able to pivot about a vertical axis 28, 28' in the direction of arrows b. Each catching fork 19 has two fork limbs 21, 21' which open outwards from a basis surface 22. The fork limbs thus form an inclined wing, which can be seen in particular in FIG. 6. In the plan, the catching fork is formed like a shovel or a plough blade. Screw holes 24 for fixation on a mounting element 27 are arranged on the basis surface 22. A larger opening 23 is also arranged in the basis surface 22, through which the screws 26, 26' can be tightened or slackened.

Both the catching forks are mounted to be able to pivot in opposite directions and each held under tension by a pressure spring 30 arranged at a distance from the pivot axis. The tensioned position is suggested by a dotted line. Each pressure spring is mounted in and acts against a bore in the holder 25.

A proximity switch 29 is mounted on each outer side of the holder 25 so that it lies within the area of action of the outer end 31 of a catching fork. Each proximity switch generates a control signal as soon as a catching fork 19 is pivoted by contact with an incorrect yarn and the outer end 31 approaches said proximity switch.

Each catching fork 19 is connected to a mounting element 27 mounted in a hollow chamber 33 in the holder 25, said hollow chamber being open towards its facing side. The mounting element 27 also serves to compensate for inertia, however, in that it forms a compensation mass 32 which compensates the mass inertia taking effect in the direction of the arrow b. On acceleration of the two sensors, said acceleration taking effect in the direction of arrow a, said sensors thus behave neutrally under the influence of mass inertia, and there is no rotational moment in the direction of arrow b. Without this inertial compensation, the sensors would respond due to the acceleration forces alone.

Naturally, depending on the yarns being worked or according to the specific prevailing operating conditions, other arrangements of sensors would be conceivable. In certain cases, for example sensors could also be arranged on different horizontal planes.

Inasmuch as the invention is subject to modifications and variations, the foregoing description and accompanying drawings should not be regarded as limiting the invention, which is defined by the following claims and various combinations thereof:

What is claimed is:

1. In a method of controlling a dividing-shed formation in a sectional warping machine, said method comprising steps of opening a yarn warp to form a shed defined by two shed warps, and introducing a dividing element for demarking the shed warps, the improvement comprising a step of, prior to the introducing step, moving at least one yarn sensor into the shed in a direction transverse to the yarn warp, and generating a control signal upon detection of a yarn in the vicinity of the sensor.

2. A method according to claim 1, wherein moving the yard sensor into the shed by means of a transporter element having a drive motor controlled by said control signal.

3. A device for controlling a dividing-shed formation on a sectional warping machine of the type in which the yarn warp can be opened up to form a shed into which a dividing element can be introduced to demark shed warps, said device comprising at least one mobile yarn sensor adapted for introduction into the opened shed in a direction transverse to the warp yarns, said yarn sensor being adapted to generate a control signal upon detecting a yarn in its vicinity.

4. A device according to claim 3, further comprising a motor-driven element transporter adapted to be controlled by said control signal, the yarn sensor being carried by the element transporter.

5. A device according to claim 3, wherein said yarn sensor is a contact sensor which can be set to generate a control signal at a predetermined yarn tension.

6. A device according to claim 5, wherein the yarn sensor comprises a catching fork having limbs defining a specific catching area in the shed.

7. A device according to claim 6, wherein the catching fork has a base surface and is formed to resemble a shovel and the fork limbs extend from the base surface in diverging directions.

8. A device according to claim 6, further comprising a fork holder, the catching fork being mounted so as to move under spring tension on the holder, and further comprising a switching element disposed on the holder, said switching element being actuatable by movement of the catching fork relative to the holder upon detection of a yarn in the catching area.

9. A device according to claim 8, wherein the switching element is a proximity switch.

10. A device according to claim 8, wherein the catching fork is pivotally mounted on the holder for movement about an approximately vertical axis and is tensioned by a spring acting against the holder.

11. A device according to claim 10, wherein the catching fork is provided with a compensating mass which, in relation to the vertical axis, is arranged in such a way that a feed acceleration of the holder does not generate a torque at the catching fork to overcome the spring tension.

12. A device according to claim 10, comprising two of said mounting forks, pivotable in opposite directions against the tension of their respective springs.

13. A device according to claim 3, wherein two of said at least one mobile yarn sensor are arranged at a distance from one another on an approximately horizontal plane.

* * * * *